United States Patent [19]

O'Brien

[11] 4,445,458

[45] May 1, 1984

[54] BEVELED EDGE METERED BEAD EXTRUSION COATING APPARATUS

[75] Inventor: William G. O'Brien, Towanda, Pa.

[73] Assignee: E. I. Du Pont De Nemours and Company, Wilmington, Del.

[21] Appl. No.: 400,245

[22] Filed: Jul. 21, 1982

[51] Int. Cl.[3] ..... B05C 5/02

[52] U.S. Cl. ..... 118/401; 118/410

[58] Field of Search ..... 118/419, 410, 411, 412, 118/401

[56] References Cited

U.S. PATENT DOCUMENTS

| | | | |
|---|---|---|---|
| 2,681,294 | 6/1954 | Beguin | 117/34 |
| 2,761,791 | 9/1956 | Russell | 117/34 |
| 2,932,855 | 4/1960 | Bartlett et al. . | |
| 3,192,895 | 7/1965 | Galer | 118/410 X |
| 3,928,679 | 12/1975 | Jackson et al. | 427/402 |
| 3,994,654 | 11/1976 | Chyu | 425/376 |
| 4,154,879 | 5/1979 | Choinski | 118/411 X |

FOREIGN PATENT DOCUMENTS

| | | | |
|---|---|---|---|
| 2043013 | 2/1971 | France . | |
| 1029017 | 5/1966 | United Kingdom | 118/411 |

*Primary Examiner*—John P. McIntosh

[57] ABSTRACT

A metered bead extrusion coating apparatus for applying a coating fluid to a moving web includes a drawdown die having a beveled drawdown surface thereon, the angle between the drawdown surface and the axis of the extrusion slot being an obtuse angle.

7 Claims, 3 Drawing Figures

BEVELED EDGE METERED BEAD EXTRUSION COATING APPARATUS

FIELD OF THE INVENTION

This invention relates to extrusion coating apparatus and more particularly to a premetered bead extrusion coating apparatus for applying a coating fluid to a web.

DESCRIPTION OF THE PRIOR ART

The bead method of applying coating fluids to a moving web is well known in the art, as shown in U.S. Pat. No. 2,681,294 (Benguin) (for a single fluid layer) and French Pat. 2,043,013 (Ilford Ltd., for plural fluid layers). The bead method uses a coating apparatus from the exit slot of which a coating fluid is fed at a controlled rate using a metering pump. The coating fluid emanates from the exit slot in the form of a wide, thin ribbon. The coating fluid is applied onto the surface of a web spaced a predetermined close distance from the mouth of the exit slot as the web is moved therepast. The web is backed by a backing roll or other suitable support surface which functions to keep the web smooth and free of vibration at the point of fluid application.

Instead of being deposited directly onto the web the layer of coating fluid leaving the coating device has a tendency to puddle on the side of the coating apparatus from which the web departs. This puddle of coating fluid extends completely across the width of the web and is normally referred to as the "bead" of coating fluid. Thus, when this coating method is used, the coating fluid is not applied directly onto the web from the coating apparatus, but the coating apparatus merely maintains the coating bead against the web. The web is thus wetted by the bead and picks up a layer of fluid as it passes therethrough. With the bead coating method, the thickness of the coating laid down on the web is determined by the action of the bead and varies with the speed of web movement, the rate of coating fluid supply, etc., and is not necessarily equal to the width of the exit slot of the coating apparatus or dependent on the distance between the mouth of the exit slot and the web.

One of the major difficulties in using the bead coating method is the maintenance of uniform contact between the bead and moving web. As the web speed is increased, viscous drag tends to distort the contacting meniscus. Air carried on the web surface is drawn under the bead at the point where the web enters the bead (the "wetdown" side of the coating apparatus) tending to lift the point of contact. At the point of exit of the web from the bead (the "drawdown" side of the coating apparatus) the bead is dragged along the web further from the mouth of the exit slot. These forces tend to produce bead instability which results in transverse coating discontinuities in the coated web. These discontinuities are known as chatter defects and are disadvantageous.

In an effort to improve bead stability, U.S. Pat. No. 2,681,294 (Beguin) teaches the use of a vacuum box disposed adjacent to the wetdown side of the coating device. By drawing a vacuum (i.e., reducing air pressure) at that point, atmospheric pressure on the drawdown side of the bead tends to press the bead against the web, thus improving bead stability and reducing chatter.

It is believed to be advantageous to provide a metered extrusion coating device wherein the occurrence of chatter defects is minimized. In addition, it is believed advantageous to provide a metered extrusion coating apparatus wherein the magnitude of the pressure force, that is, the vacuum drawn, imposed on the bead of coating fluid is minimized, thus reducing the liklihood of drawdown meniscus distortion and related coating streak formation.

SUMMARY OF THE INVENTION

The instant invention relates to a metered bead extrusion coating apparatus adapted to coat a coating fluid onto the surface of a moving web. The extrusion apparatus comprises an upstream or "wetdown", die (defined with respect to the motion of the web), a downstream or "drawdown" die, the dies being spaced apart to define an extrusion slot therebetween, the slot terminating in a mouth and having an axis extending therethrough. The extrusion coating apparatus also includes supporting means, as a backup roller, disposed in adjacency to the mouth of the slot to support the web as the coating fluid is applied thereto.

In accordance with this invention the drawdown die has a beveled drawdown surface thereon, the angle between the beveled drawdown surface and the axis of the extrusion slot being an obtuse angle lying within the range from 120 degrees to 180 degrees. In the most preferred embodiment of the invention the obtuse angle is 150 degrees.

Alternatively stated, the drawdown die includes a slot-defining surface terminating in a first edge adjacent the mouth of the extrusion slot. The bevel of the drawdown surface extends between the first edge to a second edge spaced therefrom. The distance between the second edge of the drawdown beveled surface and a reference line extending perpendicularly to the axis of the slot erected at the point where the axis intersects the surface of the web being coated is less than the distance between the first edge of the beveled drawdown surface and the reference line.

BRIEF DESCRIPTION OF THE DRAWINGS

The invention will be more fully understood from the following description thereof, taken in connection with the accompanying drawings, which form a part of this application and in which.

DETAILED DESCRIPTION OF THE INVENTION

Figure 1:
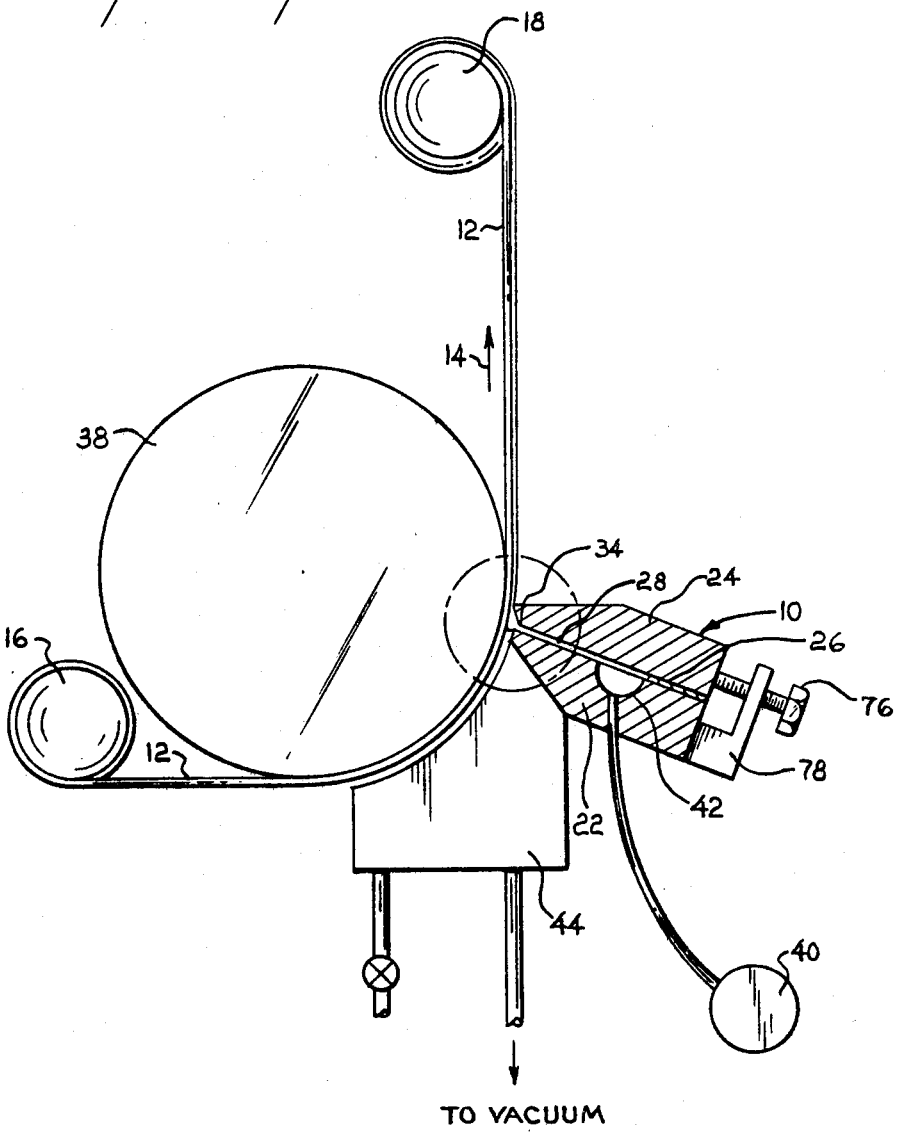
FIG. 1 is a stylized pictorial representation of a metered bead extrusion coating apparatus in accordance with the present invention for applying a coating fluid to a web.

Throughout the following detailed description similar reference numerals refer to similar elements in all figures of the drawings.

With reference to FIG. 1 a metered bead extrusion coating apparatus generally indicated by reference character 10 for applying a coating fluid to the surface of a web 12 is illustrated. The web 12 is transported in a direction indicated by an arrow 14 past the extrusion coating apparatus 10 from a supply roll 16 to takeup roll 18, all in accordance with established principles in the art.

The extrusion coating apparatus 10 includes an upstream or wetdown die 22 and a downstream or drawdown die 24. The dies 22 and 24 are separated from each other by shims 26, one of which is partially illutrated in FIG. 1. The dies 22 and 24 have slot-defining surfaces thereon which cooperate to define an extrusion slot 28 therebetween. The dies 22 and 24 and the shims 26 are held in place by suitable mounting arrangement as is well known to those skilled in the art. The slot 28 has an axis 32 (FIGS. 2 and 3) extending therethrough. The slot 28 terminates in a mouth opening 34. The mouth 34 is adjacent to yet spaced a predetermined close distance from the surface of the web 12 onto which the coating fluid exiting from the coating apparatus 10 is to be deposited.

Figure 3:
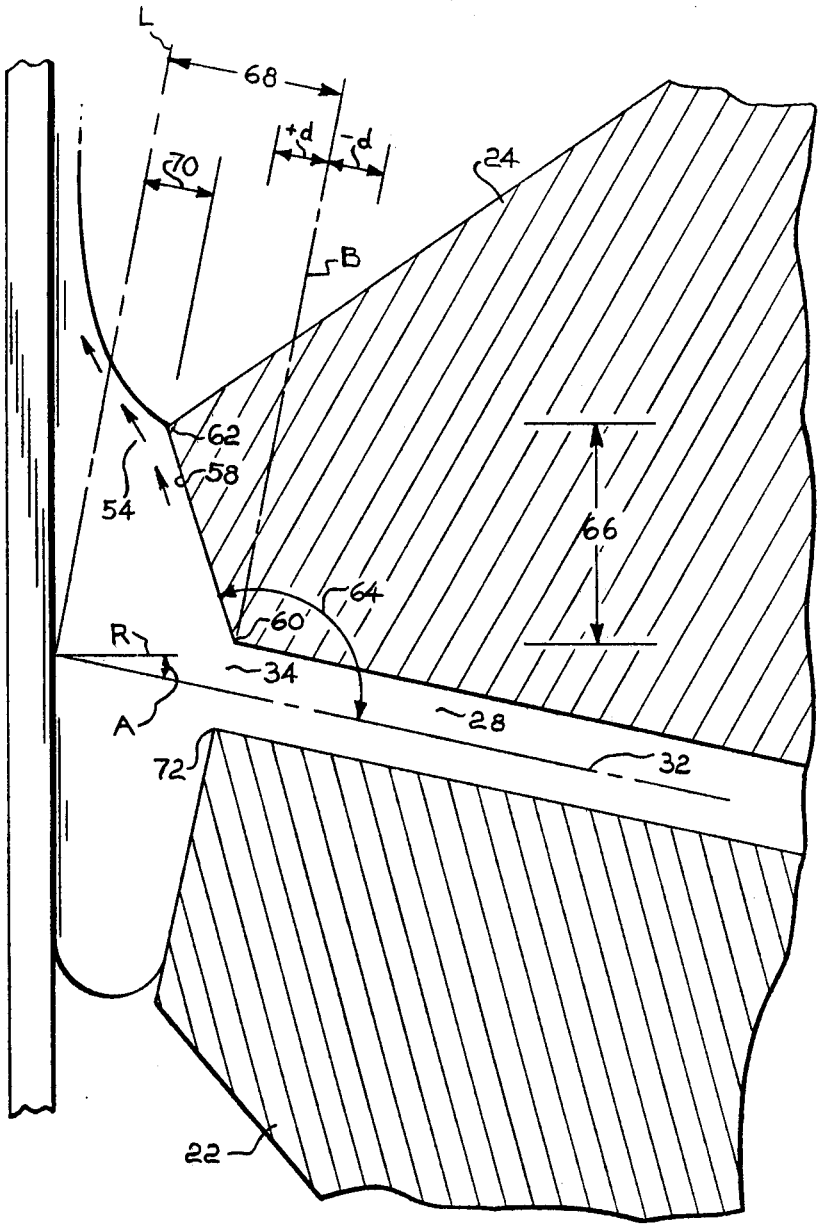
FIG. 3 is an enlarged schematic representation illustrating the metered bead extrusion coating apparatus within the circled portion of FIG. 1.

Means, such as a backup roll 38, for supporting the web in the vicinity of the mouth 34 of the slot 28 is provided. The means 38 provide a backing surface against which the coating fluid is applied onto the surface of the web. It is to be understood that although the support means 38 is illustrated in FIGS. 1 and 3 as being a roll, any suitable alternative may be utilized. For example, the support means 38 may take the form of a planar surface, a pair of spaced tensioning rollers, or an air jet.

The coating fluid to be applied to the surface of the web 12 is pumped from a supply reservoir (not shown) through a suitable metering pump 40 into a cavity 42 defined in the extrusion coating apparatus 10.

A vacuum box 44 is disposed upstream from the wetdown die 22. Air in the region between the wetdown die 22 and the web 12 is withdrawn through the vacuum box 44 by a suitable vacuum pump (not shown), thus generating a reduced pressure region beneath the coating bead.

Figure 2:
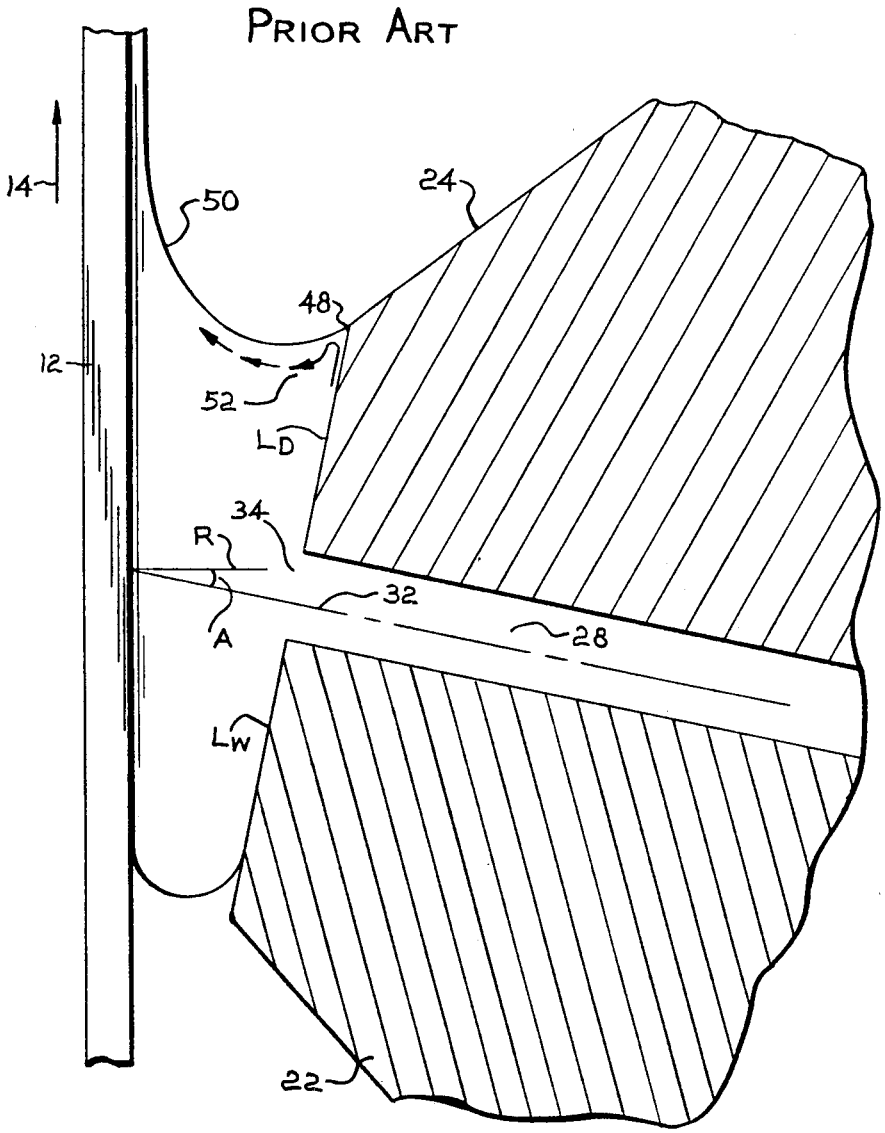
FIG. 2 is an enlarged schematic representation showing the tip of a metered bead extrusion coating apparatus used in the prior art.

With reference to FIG. 2 shown is an enlarged schematic representation of a portion of a prior art extrusion coating apparatus in the vicinity of the coating point. As seen from FIG. 2 the axis 32 of the extrusion slot 28 defines a predetermined angle A with respect to a reference line R extending perpendicularly to the surface of the web, the reference line R being erected at the point where the axis 32 of the slot 28 intercepts the web 12. It has been found that the angularity of the axis 32 of the slot 28 is necessary in order to properly apply a coating of the liquid coating solution to the web. In the prior art coating apparatus the lips $L_W$ and $L_D$ of the wetdown die and drawdown dies, respectively, are coplanar with each other. The plane of the lips of the dies diverges from the web 12 in the direction 14 of web transport.

The viscous force of the material of the coating solution and the motion of the web 12 past the mouth 34 of the slot 28 imposes a force on the bead of material tending to move the bead generally in the direction 14 of web transport. The vacuum box 44 is operative to impose a pressure force on the bead acting in the opposite direction and tending to counter the forces imposed by the moving web and the viscous and inertial forces of the material of the coating solution.

With coating apparatus of the prior art there occurs at the junction 48 of the drawdown die and the fluid meniscus 50 a sharp discontinuity in the velocity of the coating fluid. This velocity discontinuity is perhaps best understood when one follows the path of fluid flow, as indicated by the arrows 52, in the region of the miniscus 50. The velocity discontinuity is disadvantageous since it may permit foreign objects (e.g., dirt or bubbles) to enter the bead, thus enhancing the possibility of streaks. Also, for faster drying fluids, the velocity discontinuity may permit the coating fluid to dry out, which could also lead to streaks.

It has been found, however, in accordance with the instant invention, as shown in FIGS. 1 and 3, that if the drawdown die 24 is configured so as to impose a boundary force on the bead of material downstream of the slot the magnitude of the pressure forch which must be imposed on the bead by the vacuum may be reduced. In addition, the sharp velocity discontinuity early discussed is also reduced, as indicated by the flow arrows 54.

An extrusion coating apparatus 10 in accordance with the instant invention and particularly illustrating the configuration of the drawdown die 24 is shown in FIG. 3. The drawdown die 24 has a beveled drawdown surface 58 which converges toward the web 12. The drawdown surface 58 is defined between a first edge 60 (disposed adjacent to the mouth 34) and a second edge 62 spaced from the first edge 60. The beveled surface 58 defines an obtuse angle 64 between the axis 32 of the slot 28 and the beveled drawdown surface 58. The angle 64 lies within the range from about 120 degrees to about 180 degrees and most preferably is about 150 degrees. The beveled drawdown surface 58 exhibits a length dimension 66 which is related to the magnitude of the angle 64.

As seen from FIG. 3 the axis 32 of the slot 28 defines the same angle A with respect to the reference line R perpendicular to the surface of the support means at the point of intersection between the axis 32 and the support means. However, because of the provision of the obtuse angle 64 the shortest distance 68 between the first edge 60 and a line L erected perpendicular to the axis 32 at the point where the axis 32 intersects the surface of the web 12 is greater than the shortest distance 70 defined between the line L and the second edge 62 of the beveled drawdown surface 58. The lines 68 and 70 are parallel to each other.

In the use of extrusion coating apparatus 10, a number of variables are critical in obtaining the high quality needed for coating photosensitive emulsions. Thus, the flow properties of the coating fluid are very important, as well as the wet coating thickness applied onto the web and the desired coating speed. The obtuse angle 64 must therefore be optimized experimentally between the aforementioned limits of 120° to 180°, depending upon the particular fluid, the wet coating thickness and coating speed. In most cases the position of the first edge 60 of the beveled drawdown surface 58 relative to the trailing edge 72 of the wetdown die 22 must also be adjusted by shifting the drawdown die along the slot axis 32 so that the upper edge 62 of the beveled surface 58 lies at a point wherein a predetermined distance (plus d or minus d, where typically d is in the range from 0 to about 0.060 inches) of a reference line B drawn perpendicular to the slot axis and coincident with the edge 72 of the wetdown die 22.

When the upper edge 62 is located on the web side of the reference line B, the distance between the edge and the reference line is referred to as overhang. When the upper edge 62 is located on the side of the reference line away from the web, the distance between the edge and the reference line is referred to as underhang. Any suitable arrangement, such as jacking screw 76 threaded into a bracket 78 (FIG. 1) mounted to the wetdown die 22, may be used to permit the drawdown die 24 to move with respect to the wetdown die 22 to define the overhang or underhang.

Those skilled in the art, having benefit of the teachings of the present invention, as hereinabove set forth may effect numerous modifications thereto. Such modifications are to be construed as lying within the scope of the present invention, as defined by the appended claims.

What is claimed is:

1. A metered bead extrusion coating apparatus for coating a fluid onto the surface of a web supported by a backing member comprising:

a wetdown die;

a drawdown die, the wetdown die being the first die in the direction of web travel while the drawdown die is the last die in the direction of web travel, the wetdown die and the drawdown die being spaced apart to define an extrusion slot therebetween, the slot having an axis extending therethrough which intersects the backing member, the slot terminating in a mouth such that fluid emanating therefrom forms a metered bead which bridges the gap between the mouth of the slot and the surface of the web;

the drawdown die having a beveled surface thereon, the beveled surface defining an obtuse angle with respect to the axis of the slot, the beveled surface being defined between a first edge adjacent to the mouth of the slot and a second edge, the shortest distance between the first edge and a reference line extending perpendicularly to the axis of the slot erected at the point on the axis where the axis intersects the backing member being greater than the shortest distance between the second edge and the reference line.

2. The extrusion coating apparatus of claim 1 wherein the obtuse angle lies in the range from about 120 degrees to about 180 degrees.

3. The extrusion coating apparatus of claim 2 wherein the obtuse angle is about 150 degrees.

4. The extrusion coating apparatus of claims 1, 2 or 3 wherein the drawdown die is movable with respect to the wetdown die in a direction parallel to the axis of the extrusion slot a predetermined distance toward the web.

5. The extrusion coating apparatus of claims 1, 2 or 3 wherein the drawdown die is movable with respect to the wetdown die in a direction parallel to the axis of the extrusion slot a predetermined distance away from the web.

6. The extrusion coating apparatus of claim 4 wherein the distance is in the range from 0 to about 0.060 inches.

7. The extrusion apparatus of claim 5 wherein the distance is in the range from 0 to about 0.060 inches.

* * * * *